US011002432B2

(12) United States Patent
Chen et al.

(10) Patent No.: US 11,002,432 B2
(45) Date of Patent: May 11, 2021

(54) LIGHTING APPARTUS IN CLOSET

(71) Applicant: XIAMEN ECO LIGHTING CO. LTD., Xiamen (CN)

(72) Inventors: Chunteng Chen, Xiamen (CN); Lei Zhang, Xiamen (CN); Wenhui Lin, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/880,979

(22) Filed: May 21, 2020

(65) Prior Publication Data

US 2021/0080088 A1 Mar. 18, 2021

(30) Foreign Application Priority Data

Sep. 16, 2019 (CN) ..... 201921535335.8

(51) Int. Cl.

| | |
|---|---|
| ***F21V 21/00*** | (2006.01) |
| ***F21V 21/005*** | (2006.01) |
| ***F21V 23/00*** | (2015.01) |
| ***F21S 2/00*** | (2016.01) |
| ***F21V 3/00*** | (2015.01) |
| ***F21V 23/04*** | (2006.01) |
| *F21Y 103/10* | (2016.01) |
| *F21Y 115/10* | (2016.01) |

(52) U.S. Cl.

CPC ..... *F21V 21/005* (2013.01); *F21S 2/005* (2013.01); *F21V 3/00* (2013.01); *F21V 23/003* (2013.01); *F21V 23/0471* (2013.01); *F21Y 2103/10* (2016.08); *F21Y 2115/10* (2016.08)

(58) Field of Classification Search

CPC ..... F21V 21/005; F21V 3/00; F21V 23/003; F21V 23/0471; F21S 2/005; F21Y 2103/10

USPC ... 362/249.05, 219, 223, 225, 217.1, 217.13

See application file for complete search history.

(56) References Cited

U.S. PATENT DOCUMENTS

| | | | | |
|---|---|---|---|---|
| 8,104,920 | B2 * | 1/2012 | Dubord | F21V 19/0045 362/217.12 |
| 8,714,772 | B1 * | 5/2014 | Levante | F21V 19/003 362/217.17 |
| 8,888,306 | B2 * | 11/2014 | Thomas | F21V 29/71 362/92 |
| 8,899,778 | B2 * | 12/2014 | Yang | F21V 29/505 362/217.09 |

(Continued)

*Primary Examiner* — Laura K Tso

(74) *Attorney, Agent, or Firm* — Chun-Ming Shih; Lanway IPR Services

(57) ABSTRACT

A lighting apparatus includes a light source module, a light passing cover, a base housing, a first end module and a second end module. The light source module includes a plurality of LED modules. These LED modules may have different types. Each type has a different optical parameter, like color temperature, color, light intensity, color rendering index. The light passing cover allows a light of the light source module to pass through. The base housing is connected to the light passing cover forming a container space. The base housing has an elongated shape. The first end module and the second end module are attached at two opposite ends of the base housing for sealing the container space. The first end module is selectively connected to another second end module of another lighting apparatus for routing electricity and a control signal.

15 Claims, 12 Drawing Sheets

(56) References Cited

U.S. PATENT DOCUMENTS

| | | | | |
|---|---|---|---|---|
| 10,161,568 | B2 * | 12/2018 | Amrine, Jr. | F21K 9/66 |
| 2005/0068769 | A1 * | 3/2005 | Schwarz | G01N 21/8806 362/219 |
| 2007/0223210 | A1 * | 9/2007 | Schubert | F25D 27/005 362/94 |
| 2010/0124053 | A1 * | 5/2010 | Wu | F21V 15/015 362/219 |
| 2012/0300441 | A1 * | 11/2012 | Thomas | F21V 29/76 362/184 |
| 2015/0103560 | A1 * | 4/2015 | Li | F21V 21/30 362/646 |
| 2016/0116143 | A1 * | 4/2016 | Li | F21V 15/015 362/219 |
| 2016/0195250 | A1 * | 7/2016 | Park | F21S 2/005 362/219 |
| 2017/0276332 | A1 * | 9/2017 | Pearson | F21V 23/06 |

* cited by examiner

LIGHTING APPARTUS IN CLOSET

FIELD

The present application is related to a lighting apparatus and more particularly related to a lighting apparatus used in a closet.

BACKGROUND

Electroluminescence, an optical and electrical phenomenon, was discovered in 1907. Electroluminescence refers the process when a material emits light when a passage of an electric field or current occurs. LED stands for light-emitting diode. The very first LED was reported being created in 1927 by a Russian inventor. During decades' development, the first practical LED was found in 1961, and was issued patent by the U.S. patent office in 1962. In the second half of 1962, the first commercial LED product emitting low-intensity infrared light was introduced. The first visible-spectrum LED, which limited to red, was then developed in 1962.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

With high light output, LEDs are available across the visible, infrared wavelengths, and ultraviolet lighting fixtures. Recently, there is a high-output white light LED. And this kind of high-output white light LEDs are suitable for room and outdoor area lighting. Having led to new displays and sensors, LEDs are now be used in advertising, traffic signals, medical devices, camera flashes, lighted wallpaper, aviation lighting, horticultural grow lights, and automotive headlamps. Also, they are used in cellphones to show messages.

A Fluorescent lamp refers to a gas-discharge lamps. The invention of fluorescent lamps, which are also called fluorescent tubes, can be traced back to hundreds of years ago. Being invented by Thomas Edison in 1896, fluorescent lamps used calcium tungstate as the substance to fluoresce then. In 1939, they were firstly introduced to the market as commercial products with variety of types.

In a fluorescent lamp tube, there is a mix of mercury vapor, xenon, argon, and neon, or krypton. A fluorescent coating coats on the inner wall of the lamp. The fluorescent coating is made of blends of rare-earth phosphor and metallic salts. Normally, the electrodes of the lamp comprise coiled tungsten. The electrodes are also coated with strontium, calcium oxides and barium. An internal opaque reflector can be found in some fluorescent lamps. Normally, the shape of the light tubes is straight. Sometimes, the light tubes are made circle for special usages. Also, u-shaped tubes are seen to provide light for more compact areas.

Because there is mercury in fluorescent lamps, it is likely that the mercury contaminates the environment after the lamps are broken. Electromagnetic ballasts in fluorescent lamps are capable of producing buzzing mouse. Radio frequency interference is likely to be made by old fluorescent lamps. The operation of fluorescent lamps requires specific temperature, which is best around room temperature. If the lamps are placed in places with too low or high temperature, the efficacy of the lamps decreases.

In real lighting device design, details are critical no matter how small they appear. For example, to fix two components together conveniently usually brings large technical effect in the field of light device particularly when any such design involves a very large number of products to be sold around the world.

In some specific use, lighting devices may have different design concerns. For example, some lighting apparatuses are designed to be placed in a closet. When users open the closet, they do not need to rely only external light to illuminate the inner space of the closet. It is beneficial and challenging to design such lighting apparatuses to be more convenient and easier to be used while providing more flexible functions.

SUMMARY

In some embodiments, a lighting apparatus includes a light source module, a light passing cover, a driver circuit, a base housing, a first end module and a second end module.

The light source module includes a plurality of LED modules. The light passing cover is for allowing a light of the light source module to pass through. The driver circuit is used for driving the light source module.

The base housing is connected to the light passing cover forming a first container space enclosing the light source module.

The base housing further includes a second container space for storing the driver circuit. The base housing has a separator for separating the first container space and the second container space. The base housing has an elongated shape.

The first end module and the second end module are attached at two opposite ends of the base pate for sealing the first container space and the second container space. The first end module is selectively connected to another second end module of another lighting apparatus for routing electricity and a control signal.

The light source module is located at the first end module for emitting light to a light guide disposed on the base housing.

The first end module and the second end module have different structures. The first end module has a pluggable structure corresponding to the second end module.

The lighting apparatus is installed in a closet for connecting a socket getting an electricity supply.

A door sensor of the closet triggers the driver circuit to turn on the light source module when an associated door is open. A control message of the door sensor is transmitted to all connected lighting apparatus.

The first end module is removable to be replaced with another first end module with different parameters.

In some embodiments, the base housing has at least one slot for plugging in at least one function module.

In some embodiments, the light passing cover has a buckle structure to plug to a corresponding groove of the base housing with a deformation.

In some embodiments, a first end of a forking connector is connected to the first end module. Multiple second ends are connected to another second end module of another multiple lighting apparatuses.

In some embodiments, the base housing has a manual switch for selecting a parameter set optimized for an object category. Multiple object categories are selectable on the manual switch.

In some embodiments, the lighting apparatus includes a function module with a third end module and a fourth end module. The third end module has the same structure as the first end module. The fourth end module has the same structure as the second end module. The fourth end module is connected to the first end module.

In some embodiments, the lighting apparatus further includes a manual switch connecting to the driver circuit to turn on the light source module.

In some embodiments, multiple lighting apparatuses are connected in series forming a frame.

In some embodiments, a length of the base housing is adjustable.

In some embodiments, the lighting apparatus further includes a pose sensor for detecting a pose to place the lighting apparatus. The driver circuit controls the light source module to emit different lights when the lighting apparatus is placed horizontally and when the lighting apparatus is placed vertically.

In some embodiments, the lighting apparatus further includes a rotation structure attached to the base housing for adjusting an output light direction of the light source module.

In some embodiments, a control message of the lighting apparatus is transmitted to another lighting apparatus.

In some embodiments, multiple lighting apparatuses connected in series are synchronized to work together to emit a collaborative light effect.

In some embodiments, the base housing has a manual switch for setting a parameter of the light source module.

In some embodiments, the base housing has a slot for inserting a memory card. The memory card stores parameters for controlling the light source module.

DETAILED DESCRIPTION

Figure 1:
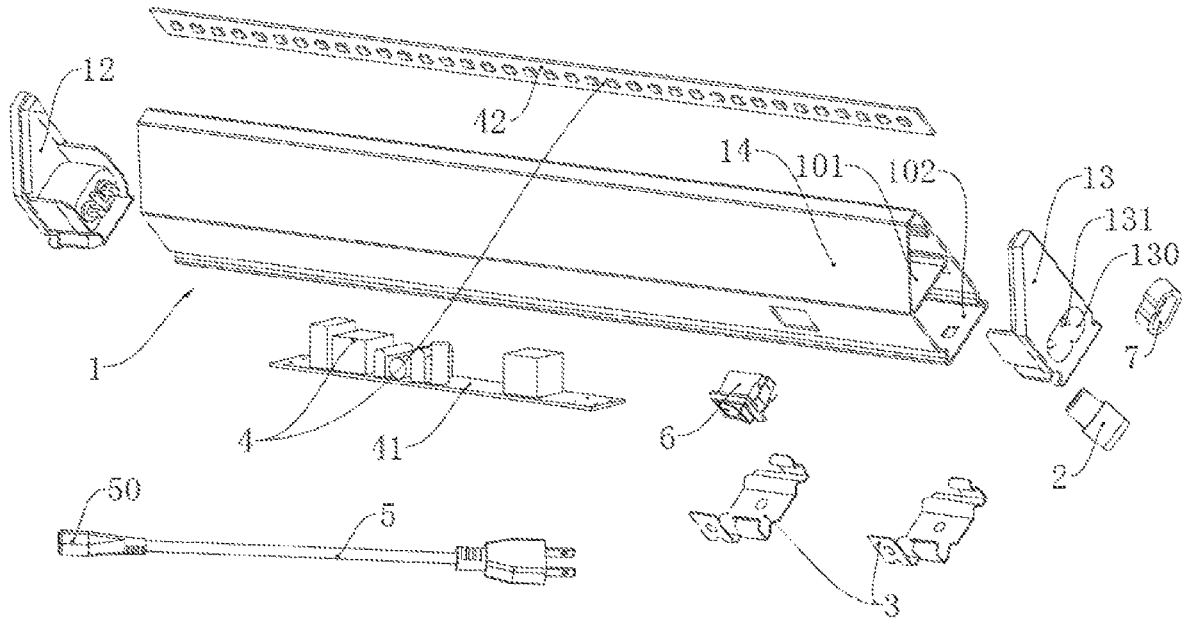
FIG. 1 is an exploded view of a lighting apparatus embodiment.
Figure 2:
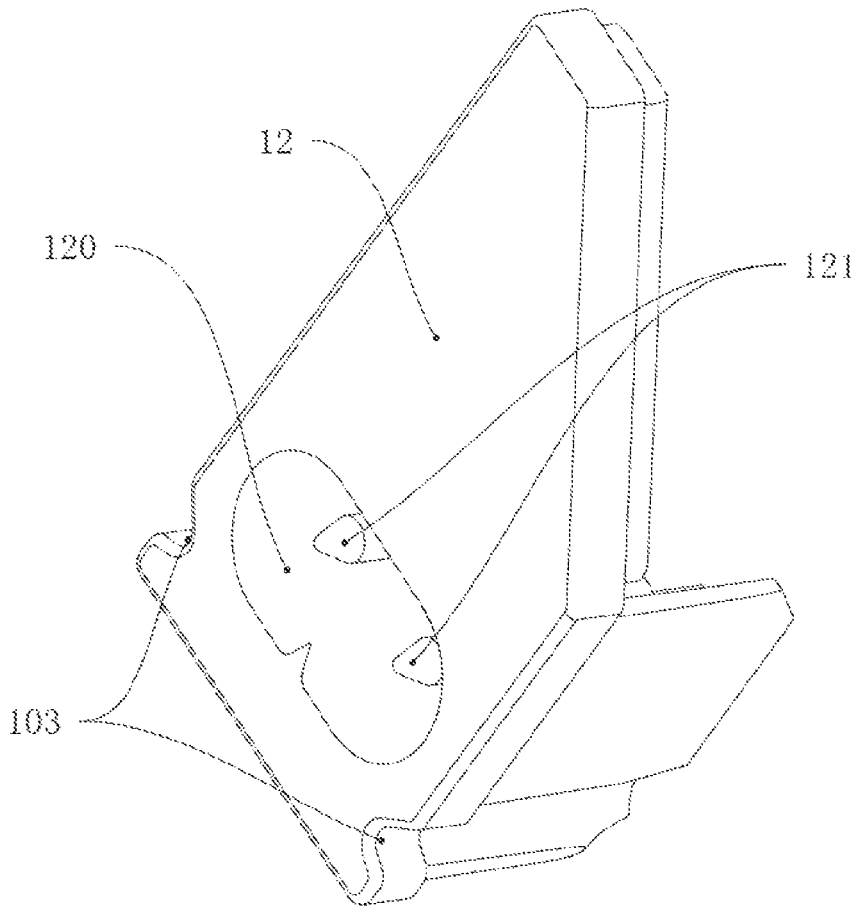
FIG. 2 is an example of an end module.

Please refer to FIG. 1, FIG. 2, FIG. 3 and FIG. 6. In an embodiment, a closet light includes a base housing and a power wire 5. The base housing 1 has a first end box and a second end box respectively plugged to two opposite ends of the base housing 1. The base housing 1 has a cavity passing through the length direction. A light source module 4 is disposed inside the cavity of the base housing 1. The first end box has a first socket. The light source module 4 is fixed in the first socket electrically connected to a first conductive column. The second end box has a second socket. The light source module 4 is fixed in the second socket electrically connected to a second conductive column 131. The power wire 5 has a plug head matching to the first socket and/or the second socket. The plug head is connected to the first socket or the second socket and is electrically connected to the first conductive column or the second conductive column 131. Among them, the first end box and/or the second end box may also be connected a routing connector 2. The routing connector 2 is for connecting two base housings. The routing connector 2 has a conductive sleeve 20 reaching from an end to the other end. The first socket and the second socket are respectively connected to two opposite ends of the routing connector 2 and the first conductive column and the second conductive column 131 are respectively connected to two opposite ends of the conductive sleeve 20.

In an embodiment, the closet light is provided comparing to conventional art. The light source module 4 is in the cavity of the base housing 1 forming a construction with a better appearance with better space saving. The two ends of the routing connector 2 are respectively plugged to the first socket of the base housing 1 and the second socket of the adjacent base housings, and the two opposite ends of the conductive sleeve 20 are respectively connected to the first conductive column of the two base housings and electrically connected to the second conductive column 131. After the routing connector 2 is respectively plugged to the first socket and the second socket, the end portion of the two base housings may meet together for providing a seamless connection of two or more base housings. The plug head 50 of the power wire 5 is matching to the first socket and/or the second socket, after finishing installing multiple base housings, the plug head 50 is plugged into the first socket or the second socket of the outer base housing and electrically connected to a power. The closet light may be used individually, and also at least two base housings may be linear connected. The routing connector 2 is used for connecting between each base housing. The connection between multiple base housings is easy and provides a seamless connection between two adjacent closet light apparatus for avoiding the connecting wire exposed outside.

Figure 4:
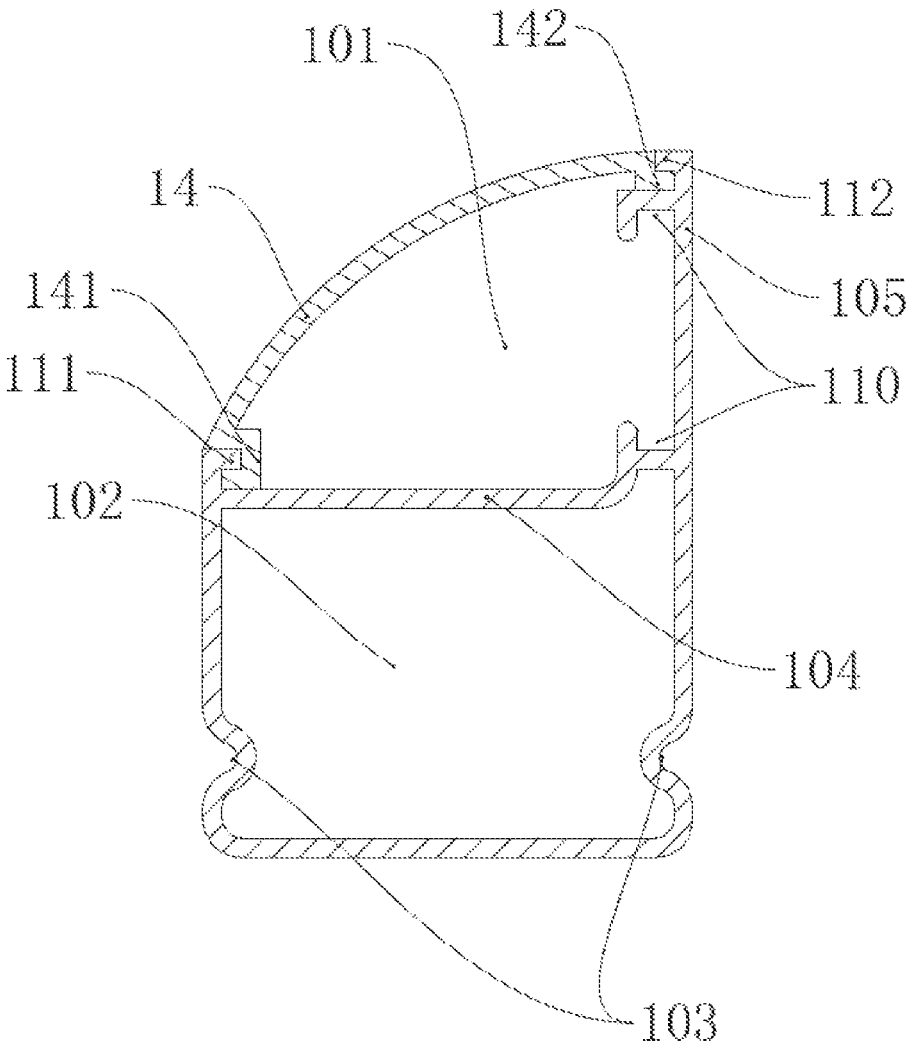
FIG. 4 shows a cross section view of an embodiment.

Please refer to FIG. 1 and FIG. 4. The base housing 1 includes a main housing, a light passing cover 14 and a separator. The main housing has an opening side and the light passing cover 14 is connected onto the opening side. The separator is fixed inside the main housing and the separator reaches from an end of the main housing to the other end of the main housing. The separator, the light passing cover 14 and the main housing at the top part of the separator are surrounded as a first container space for installing a LED strip 42 of the light source module 4. The separator and the main housing at the bottom part of the separator are surrounded as a second container space for installing a driver circuit 41 of a light source module 4. The first container space has a first container wall vertical to the board surface of the separator. The LED strip 42 is connected on the first container wall and electrically connected to the driver circuit 41.

The driver circuit 41 and the LED strip 42 are respectively fixed inside the second container space 102 and the first container space 101. In order to avoid the driver circuit 41 covering the light emitted by the LED strip 42, the LED strip 42 is connected to the first container wall 105 vertical to the separator 104 for emitting light straight to the light passing cover 14. The separator 104 and the first container wall are vertical connected such as two angle side of the right triangle, thus, the light passing cover 14 is tilt facing relative to the separator such as two hypotenuses of the right triangle which provides a larger surface for the light passing cover 14.

Please refer to FIG. 1 and FIG. 4. In an embodiment of the closet light, the first container wall 105 has a plugged groove 110 reaching from an end to the other end of the first container 101, and the LED strip 42 is plugged to the plugged groove 110. The LED strip 42 may only need to be taken off the first end box 12 or the second end box 13 when detaching. It is easy and convenient for moving out the LED strip 42 from the plugged groove 110 detaching the LED strip 42.

Please refer to FIG. 4. In an embodiment of the closet light, the light passing cover 14 has a buckle set along the edge parallel to the length direction of the light passing cover 14. The buckle reaches along the inner side of the light passing cover 14. A side edge of the separator 104 connected to the light passing cover 14 has a first buckle connecting portion 141. A side edge of the first container wall 105 connected to the light passing cover 14 has a second buckle connecting portion 142. The two buckles are respectively connected to the first buckle connecting portion 141 and a second buckle connecting portion 142.

In an embodiment, one of the buckles is a first buckle 111 connected to the first buckle connecting portion 141. The first buckle 111 is a U shape. Another buckle is a second buckle 112 as a L shape. The first buckle connecting portion 141 and the second buckle connecting portion 142 are folding edge structure. The folding edge of the first buckle connecting portion 141 connected to the board surface of the separator 104 forms a first slot. The folding edge of the second buckle connecting portion 142 connected to the side wall of the plugged groove 110 forms a second slot. First, plug the folding edge of the first buckle connecting portion 141 into the U-shaped slot of the first buckle 111 so that the outer side wall of the U-shaped slot is connected to the surface board of the separator 104 when installing the light passing cover 14. Second, plug the second buckle 112 into the second slot for connecting the bottom surface of the second buckle 112 to the side wall of the plugged groove 110 for providing a stable light passing cover 14.

In an embodiment, the light passing cover 14 is vertical to the longitudinal direction of the cross-section as a curved shape for a better appearance and a larger light emitting area. Furthermore, the curved structure makes the toughness of the light passing cover 14 for being properly bendable during installation.

Figure 5:
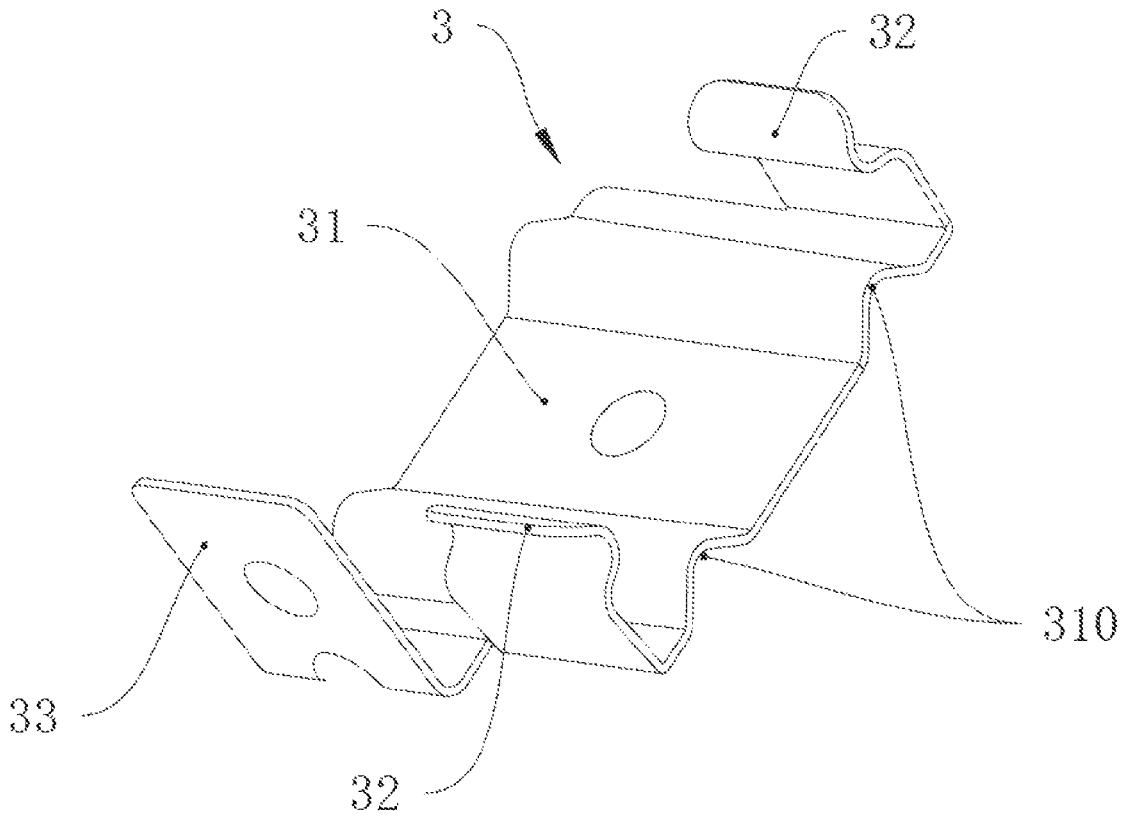
FIG. 5 shows a connector used for fixing a lighting apparatus.

Please refer to FIG. 4 and FIG. 5. In an embodiment of the closet light, the two relative outer tube walls of the base housing 1 each has a socket 103. The two sockets 103 have an elastic clip brace 3 disposed thereon. The elastic clip brace 3 is for fixing inside the closet. First, fasten at least two elastic clip braces 3 to the side wall or the ceiling wall of the closet. Each length of the elastic clip braces is set according to the length of the base housing. The base housing then passes the socket 103 buckled to the elastic clip brace 3. The base housing may be adjusted through sliding by the elastic clip braces 3.

Please refer to FIG. 5. The elastic clip brace 3 includes a first installation plate 31 and two elastic clip boards 32 vertical to the two opposite ends of the surface board of the first installation plate 31. The center of the installation plate 31 has an installation hole. The two elastic clip boards are respectively buckled to the socket 103. The elastic clip brace 3 may be fastened by the installation hole. The elastic clip board buckle is buckle connected to the socket 103 for using the elastic force of the base housing as a clip to ensure the base housing to be stable.

Please refer to FIG. 5. The first installation plate 31 and the two elastic clip boards 32 have waving-shaped protrusions 310. The waving-shaped protrusion 310 of the first installation plate 31 may avoid the interference of a fasten portion and the base housing after fastening the elastic clip brace 3 through the fasten portion. The waving-shaped protrusion 310 of the elastic clip board 32 may make the width of the opening formed by two elastic clip boards wider than the width of the base housing. Align between the two elastic clip board 32 and press the base housing for buckling the waving-shaped protrusion 310 of the two elastic clip board 32 into the socket 103 when installing the base housing.

Please refer to FIG. 5. In an embodiment of the closet light, the first installation plate 31 has an end vertically connected to a second installation plate 33. The second installation plate 33 is set external to the two elastic clip board 32. The closet light is most often set to the connection between the side wall and the ceiling wall of the closet, the second installation plate 33 is vertical to the first installation plate 31 which may fasten the first installation plate 31 to the side wall and the second installation plate 33 to the ceiling wall of the closet for fastening. The second installation plate 33 is outside the two elastic clip board 32 for avoiding the second installation plate 33 inferred the buckle connection of the base housing and the elastic clip brace 3.

Please refer to FIG. 1. A first socket 120 and a second socket 130 each has a protective plug 7. Before the base housing is installed, the protective plug 7 may protect the first conductive column 121 and the second conductive column 131 for not being broken. After installing the base housing, remove the protective plug 7 and plug connected the routing connector 2. The first socket 120 or the second socket 130 of the outer base housing may not have to install, thus, the protective plug 7 needs to be plugged for protection and avoid the user being electrocuted when touching the first conductive column 121 or the second conductive column 131.

Figure 6:
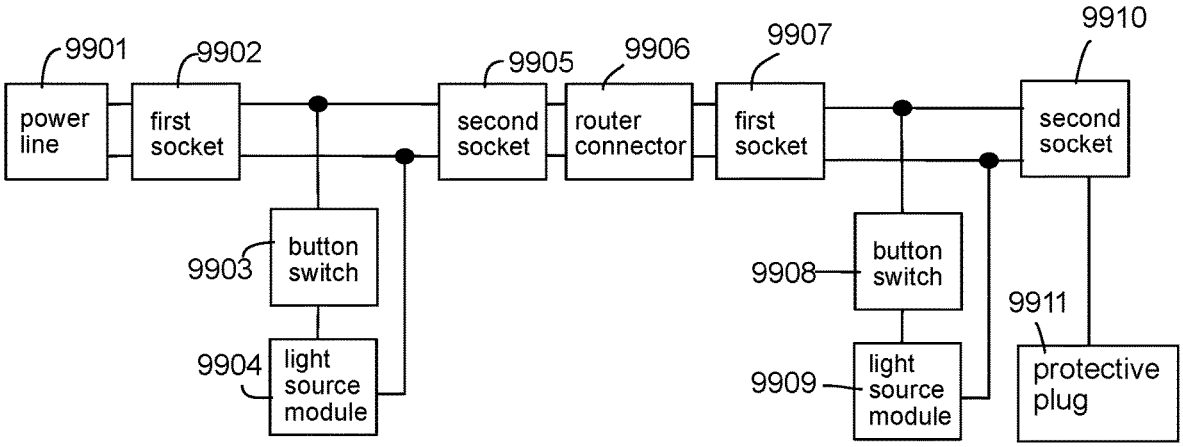
FIG. 6 shows a concept diagram for connecting two lighting apparatuses.

Please refer to FIG. 1 and FIG. 6. In an embodiment of the closet light, the outer wall of the base housing 1 has a button switch 6 electrically connected to the light source module 4 for a convenience of electrically connected and disconnected to every base housing.

Figure 3:
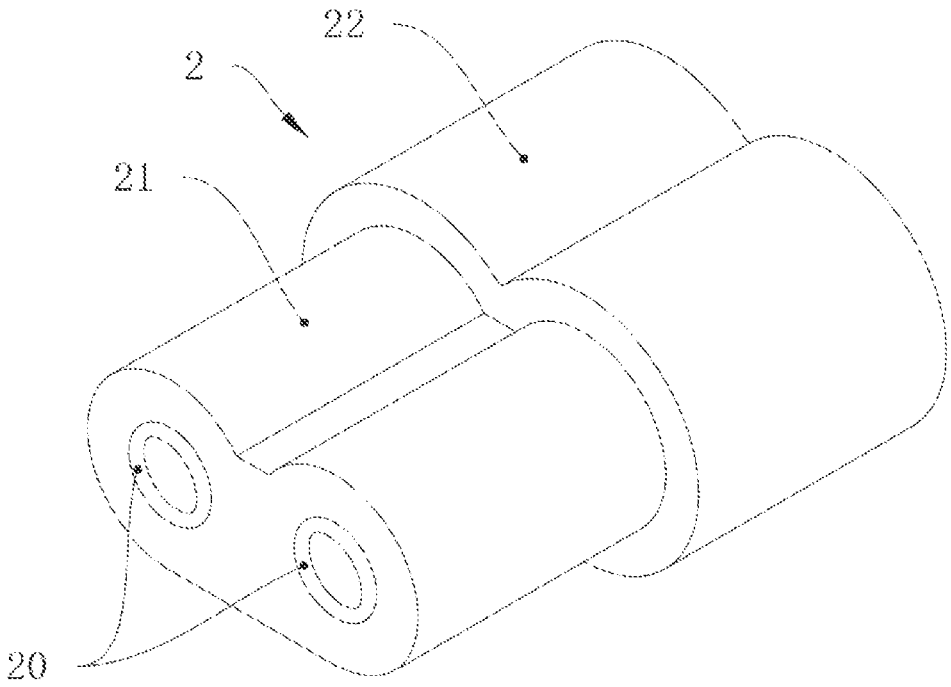
FIG. 3 shows a routing connector.

Please refer to FIG. 3. In an embodiment of the closet light. The routing connector 2 has an end which is a large diameter plug piece 22. The other end of the routing connector 2 is a small diameter plug piece 21. The large diameter plug piece and the small diameter plug piece is seamless. The depth of the first socket 120 is the same as the length of the large diameter plug piece 22. The depth of the second socket 130 is the same as the depth of the small diameter plug piece 21. When installing the base housing, the large diameter plug piece 22 is plugged to the first socket 120 which makes the end surface of the large diameter plug piece 22 connected to the bottom surface of the first socket 120, and plug the small diameter plug piece 21 to the second socket 130 which makes the end surface of the small diameter plug piece 21 connected to the bottom surface of the second socket 130 for ensuring a stable connection between the two base housing and the seamless connection between the two base housing.

In some embodiments, a lighting apparatus includes a light source module, a light passing cover, a driver circuit, a base housing, a first end module and a second end module.

The light source module includes a plurality of LED modules. The light passing cover is for allowing a light of the light source module to pass through. The driver circuit is used for driving the light source module.

The base housing is connected to the light passing cover forming a first container space enclosing the light source module.

The base housing further includes a second container space for storing the driver circuit. The base housing has a separator for separating the first container space and the second container space. The base housing has an elongated shape.

The first end module and the second end module are attached at two opposite ends of the base pate for sealing the first container space and the second container space. The first end module is selectively connected to another second end module of another lighting apparatus for routing electricity and a control signal.

In some embodiments, the light guide may be replaced with another light guide with different parameters.

In some embodiments, the light guide is integrated with the light passing cover.

In some embodiments, the light guide is detachable to be removed from the base housing and replaced with another light guide.

For example, different colors or light guides may be replaced for providing a different light effect.

In some embodiments, a lighting apparatus includes a light source module, a light passing cover, a base housing, a first end module and a second end module.

The light source module includes a plurality of LED modules. These LED modules may have different types. Each type has a different optical parameter, like color temperature, color, light intensity, color rendering index.

The light passing cover allows a light of the light source module to pass through.

The base housing is connected to the light passing cover forming a container space. The base housing has an elongated shape.

The first end module and the second end module are attached at two opposite ends of the base pate for sealing the container space. The first end module is selectively connected to another second end module of another lighting apparatus for routing electricity and a control signal. Specifically, such lighting apparatus has great scalability. More than one same type of different types of such lighting apparatuses may be connected in series once they have the same first end mode and the second end module.

For example, the first end module of a first lighting apparatus is connected to the second end module of a second lighting apparatus. The first end of the second lighting apparatus is connected to the second end module of a third lighting apparatus. The first end module may be connected to a power source, e.g. a battery pack, a power adaptor converting 110V/220V alternating current source to a DC power source, or an indoor power socket when the first end module has a driver for converting the indoor power to a DC power source.

Other lighting apparatus, like the second lighting apparatus and the third lighting apparatus may receive power from the first lighting apparatus. In this example, the third lighting apparatus receives power from the second lighting apparatus.

In addition to route electricity from one lighting apparatus to another lighting apparatus, control signals and other parameter settings may be transmitted among the lighting apparatuses.

For example, a turn-on command, a color temperature adjustment command, a adding-intensity (adding luminance level), audio data, synchronous signals for multiple lighting apparatuses to work together in time, may be routed to the connected lighting apparatuses.

In some embodiments, the first end module and the second end module may have cover housings for concealing the container space together with the light passing cover and the base housing. Specifically, the first end module may include plastic or other material housing component to be attached to the base housing. In addition, the first end module may have electricity components to convert power, rectify power, filter power, parse control command, route messages to a next lighting apparatus.

In some embodiments, the first end module may be detached from the lighting apparatus and be replaced with another end module with the same housing so as to connect to a second end module of another lighting apparatus, but include different circuits within the first end module. For example, some first end module may have the same appearance as other first end modules, but have wireless circuit for receiving wireless data from an external device. For a series of connected lighting apparatuses, not necessary every lighting apparatus has the capability of wireless transmission, which may cause higher cost. Instead, if one lighting apparatus has the wireless transmission function, other lighting apparatuses may receive an external command via the lighting apparatus.

It is even better that people may choose the first end modules with different functions and integrate the first end module to the lighting apparatus to satisfy their needs.

All function mentioned above may be implemented at the second end module at the same time. In some other embodiments, some circuits may be placed in the first end module and some other circuits may be placed in the second end module. The first end module and the second end module may co-work together for provide desired function together.

When the first end module is detachable, there is an inner connector for connecting to the first end module. The inner connector may have the same connecting structures as the first end module while the first end module has an additional connector structure as the second end module.

Specifically, the first end module is connected to the inner connector with its connector like the second end module. In such design, the first end module is just like another lighting apparatus, just without a light source module.

More than one first end modules may be connected in series and then connected to one lighting apparatus for providing necessary functions. These first end modules may have different functions, and their connection provides combined functions.

In some embodiments, the light source module is disposed on the base housing.

In some embodiments, the light source module is located at the first end module for emitting light to a light guide disposed on the base housing.

In some embodiments, the light guide is integrated with the light passing cover.

In some embodiments, the light guide is detachable to be removed from the base housing and replaced with another light guide.

For example, different colors or light guides may be replaced for providing a different light effect.

In some embodiments, the first end module and the second end module have different structures. The first end module has a pluggable structure corresponding to the second end module.

For example, the first end module may have a male connector structure while the second end module have female connector structure. With such structures, multiple lighting apparatuses may be connected in series. The head lighting apparatus may receive electricity and control signals and routes the electricity and the control signals to other connected lighting apparatuses.

In some embodiments, the first end module has a larger size socket and the second end module has a smaller size socket. By providing different sizes of sockets, the first end module and the second module are recognized and for connecting successfully in series with other lighting apparatuses.

Figure 7:
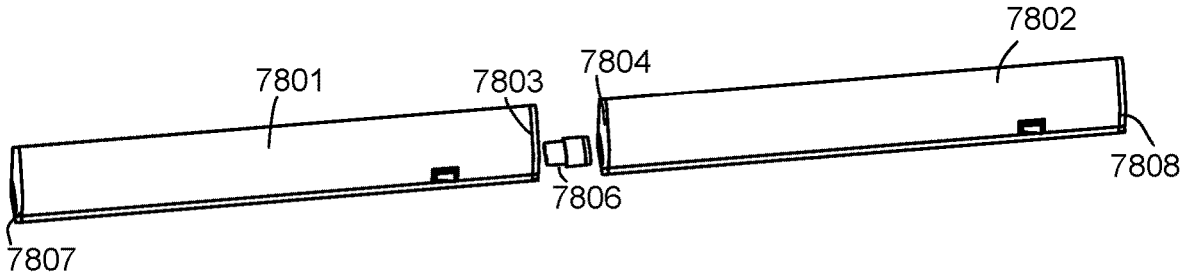
FIG. 7 shows two lighting apparatuses connected in series.

In FIG. 7, a first lighting apparatus 7801 has a first end module 7807 and a second end module 7803. The second lighting apparatus 7802 has a first end module 7804 and a second end module 7808. There is a routing connector 7806 connecting the second end module 7803 of the first lighting apparatus 7801 and the first end module 7804 of the second lighting apparatus 7802.

In FIG. 6, a first lighting apparatus has a first socket 9902 as the first end module, a second socket 9905 as the second end module, a button switch 9903 for turning on or turning of the light source module 9904 of the first lighting apparatus.

A router connector 9906 is used for connecting the second socket 9905 and the first socket 9907 of a second lighting apparatus. The second lighting apparatus, like the first lighting apparatus, also has a first socket 9907 and a second socket 9910. In addition, the second lighting apparatus also has a button switch 9908 for separately turning on or turning off the light source module 9909.

The first socket 9902 of the first lighting apparatus is also connected to a power line 9901. The second socket 9910 of the second lighting apparatus is connected to a protective plug 9911 for preventing dust or water.

Figure 8:
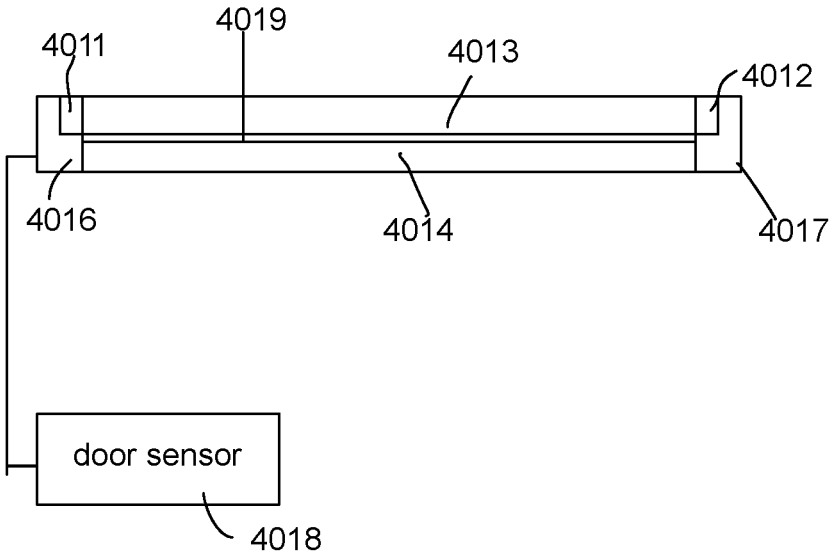
FIG. 8 shows a closet application.

In FIG. 8, the lighting passing cover 4013 stored in a first container space provides light to pass through and the second container space 4014 of the base housing provides a place for storing a driver circuit. There is a separator 4019 for separating the first container space and the second container space.

There is a first end module 4016 and a second end module 4017 for connected to other components like another lighting apparatus or a door sensor. There is an electrode 4011 in the first end module 4016 and an electrode 4012 for the second end module 4017.

In some embodiments, the light passing cover 4013 is rotatable with respect to the base housing for changing a light beam of the lighting apparatus, e.g. for projecting light to a desired object or an area.

In some embodiments, the lighting apparatus is installed in a closet for connecting a socket getting an electricity supply.

In FIG. 8, a door sensor of the closet triggers a driver circuit in the first end module to turn on the light source module when an associated door 4018 is open.

In some embodiments, the first end module is removable to be replaced with another first end module with different parameters.

In some embodiments, the first end module has at least one slot for plugging in at least one function module.

In some embodiments, multiple function modules are plugged and interact together with a driver in the first end module.

Figure 9:
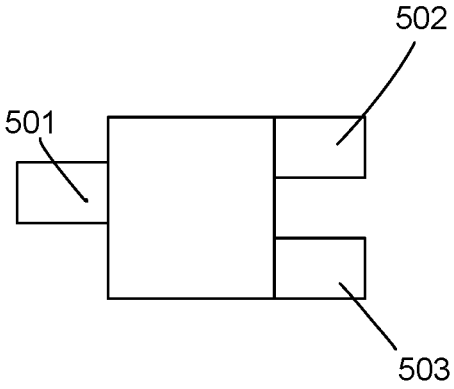
FIG. 9 shows a forking connector.

In FIG. 9, a first end of a forking connector 501 is connected to the first end module and multiple second ends 502, 503 are connected to another second end modules of another multiple lighting apparatuses.

Figure 10:
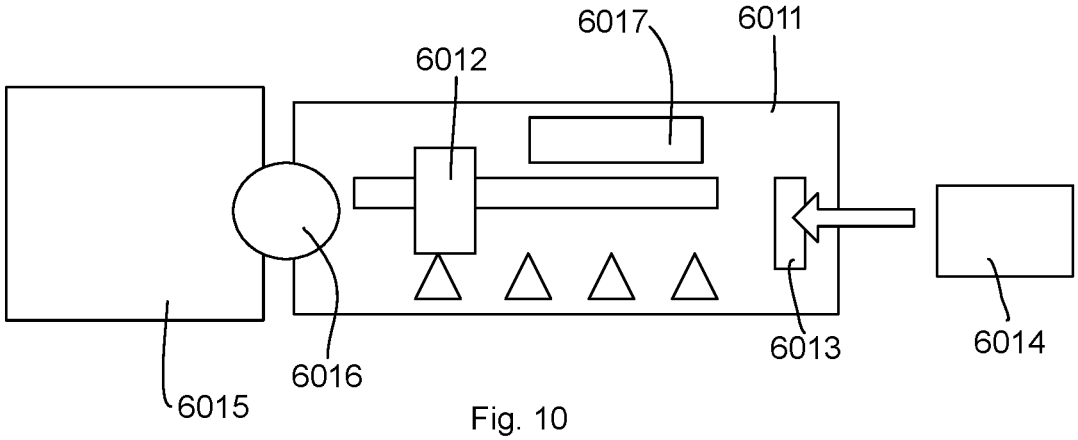
FIG. 10 shows a rotating connector.

In FIG. 10, the first end module 6011 has a manual switch 6012 for selecting a parameter set optimized for an object category, multiple object categories are selectable on the manual switch.

For example, a first parameter set is optimized for projecting light on clothing. A second parameter set is optimized for projecting light on jewelry. A third parameter set is optimized for projecting light on cups and dishes.

This is different from manual switches only provided for selecting a desired color temperature or a color rendering index.

Most people do not have knowledge and sensitivity to adjust the light to optimize the visual effect when the light is projected to different objects.

But, such function is critical for projecting lights on objects when they are installed in closet or a gallery box.

Common used parameter sets may be optimized and stored for users to select one object category.

It is possible for providing an advanced setting on such manual switch.

For example, the same parameter set may correspond to different control signals when the light source module is used in day time or night time.

In some other embodiments, the parameter set may be downloaded from Internet and transmitted to the lighting apparatus by an external device like a mobile phone.

In some embodiments, the lighting apparatus may also include a function module with a third end module and a fourth end module The third end module has the same structure as the first end module fourth end module has the same structure as the second end module fourth end module is connected to the first end module.

The function module is made as the lighting apparatus mentioned above, just such function module does not encompass a light source module but a function circuit, e.g. a wireless module, a sensor, a processor.

Such function module is connected to the first end module to extend the lighting apparatus. The extended lighting apparatus still has a first end module using the third end module to connect to another second box of another lighting apparatus.

In FIG. 10, the first end module has a battery module 6017 for supplying power to the light source module.

Figure 11A:
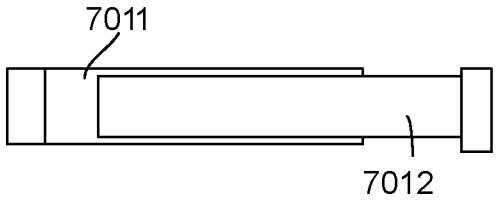
FIG. 11A and FIG. 11B show an example with adjustable housing length.
Figure 11B:
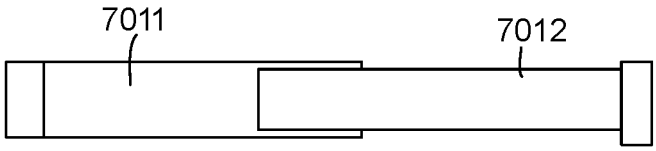
Figure 12:
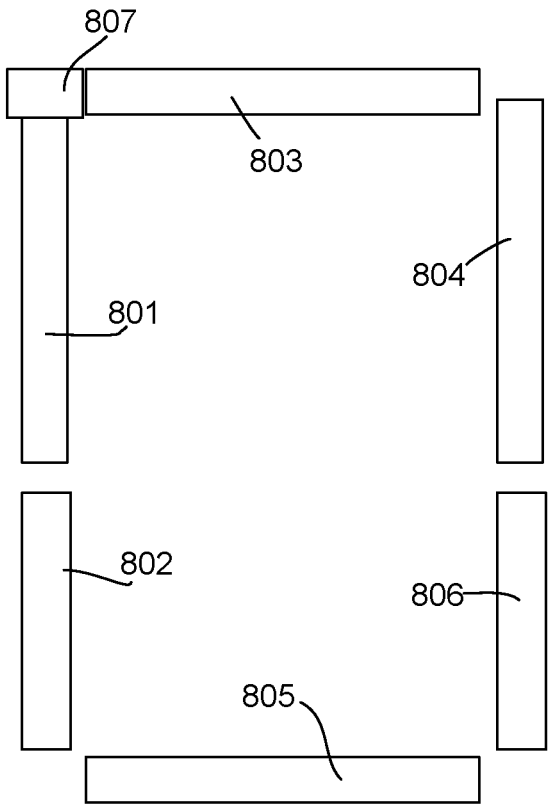
FIG. 12 shows a frame composed by multiple lighting apparatuses.

In FIG. 12, multiple lighting apparatuses 801, 802, 803, 804, 805, 806 are connected in series forming a frame. As explained in FIG. 11A and FIG. 11B, such lighting apparatus may be adjusted for their lengths to fit to a closet. For corner portion, a corner connector 807 may be used for rotatable first end module may be used for forming a frame shape structure.

In FIG. 11A and FIG. 11B, a length of the base housing is adjustable. Specifically, the base housing has a first portion 7011 and a second portion 7012. The first portion 7011 and the second portion 7012 are shifted to change a total length of the lighting apparatus, as illustrated in FIG. 11A and FIG. 11B.

In some embodiments, the lighting apparatus may also include a pose sensor for detecting a pose to place the lighting apparatus and a driver of the lighting apparatus controls the light source module to emit different lights when the lighting apparatus is placed horizontally and when the lighting apparatus is placed vertically.

In FIG. 10, the lighting apparatus may also include a rotation structure 6016 attached to the base housing 6015 for adjusting an output light direction of the light source module.

In some embodiments, a control message of the lighting apparatus is transmitted to another lighting apparatus. For example, a signal line or multiple signal lines may be used for routing information like control signals and disposed to the first end module and the second end module.

In some embodiments, multiple lighting apparatuses connected in series are synchronized to work together to emit a collaborative light effect.

In some embodiments, the first end module has a manual switch for setting a parameter of the light source module. For example, a series of electronic signals like 0100101, wherein 0 represents low voltage level and 1 represents high voltage level, is used as a sync signal. In addition to connect the lighting apparatuses in series for routing power electricity, control signals are routed too. Such sync signal is recognized by a processor in the first end module and translated to synchronize action with other lighting apparatuses for executing a predetermined program.

In previous embodiments, function modules or processing circuits are installed in the first end module. These functions and circuits may also be partially placed in the second end module or other places of the lighting apparatus, e.g. a driver circuit in the middle of the base housing mentioned above.

In FIG. 10, the first end module 6011 has a slot 6013 for inserting a memory card 6014, the memory card 6014 stores parameters for controlling the light source module.

The memory card may be inserted to an external computer for downloading or editing. The parameters and settings are then put back to the lighting apparatus when the memory card is inserted to the lighting apparatus.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

a light source module comprising a plurality of LED modules;

a light passing cover, for allowing a light of the light source module to pass through;

a driver circuit for driving the light source module;

a base housing connected to the light passing cover forming a first container space enclosing the light source module, the base housing further comprising a second container space for storing the driver circuit, the base housing having a separator for separating the first container space and the second container space, the base housing having an elongated shape;

a first end module; and a second end module, wherein the first end module and the second end module are attached at two opposite ends of the base housing for sealing the first container space and the second container space, the first end module is selectively connected to another second end module of another lighting apparatus for routing electricity and a control signal, wherein the light source module is located at the first end module for emitting light to a light guide disposed on the base housing.

2. The lighting apparatus of claim 1, wherein the first end module and the second end module have different structures, the first end module has a pluggable structure corresponding to the second end module.

3. The lighting apparatus of claim 1, wherein the lighting apparatus is installed in a closet for connecting a socket getting an electricity supply.

4. The lighting apparatus of claim 3, wherein a door sensor of the closet triggers the driver circuit to turn on the light source module when an associated door is open, a control message of the door sensor is transmitted to all connected lighting apparatus.

5. The lighting apparatus of claim 1, wherein the base housing has at least one slot for plugging in at least one function module.

6. The lighting apparatus of claim 1, wherein the light passing cover has a buckle structure to plug to a corresponding groove of the base housing with a deformation.

7. The lighting apparatus of claim 1, further comprising a manual switch connecting to the driver circuit to turn on the light source module.

8. The lighting apparatus of claim 1, wherein multiple lighting apparatuses are connected in series forming a frame.

9. The lighting apparatus of claim 8, wherein a length of the base housing is adjustable.

10. The lighting apparatus of claim 8, further comprising a pose sensor for detecting a pose to place the lighting apparatus and the driver circuit controls the light source module to emit different lights when the lighting apparatus is placed horizontally and when the lighting apparatus is placed vertically.

11. The lighting apparatus of claim 1, further comprising a rotation structure attached to the base housing for adjusting an output light direction of the light source module.

12. The lighting apparatus of claim 1, wherein a control message of the lighting apparatus is transmitted to another lighting apparatus.

13. The lighting apparatus of claim 12, wherein multiple lighting apparatuses connected in series are synchronized to work together to emit a collaborative light effect.

14. The lighting apparatus of claim 1, wherein the base housing has a manual switch for setting a parameter of the light source module.

15. The lighting apparatus of claim 1, wherein the base housing has a slot for inserting a memory card, the memory card stores parameters for controlling the light source module.

* * * * *